United States Patent [19]

Kreuzman

[11] 4,204,679

[45] May 27, 1980

[54] TENNIS PRACTICE SERVING NET

[76] Inventor: Harry E. Kreuzman, 5201 Cherokee Dr., Troy, Mich. 48098

[21] Appl. No.: 954,510

[22] Filed: Oct. 25, 1978

[51] Int. Cl.[2] ..... A63B 61/00

[52] U.S. Cl. ..... 273/29 A; 273/354; 273/402

[58] Field of Search ..... 273/29 A, 29 R, 30, 273/127 D, 127 R, 95 H, 105 A, 105 R

[56] References Cited

U.S. PATENT DOCUMENTS

| | | | |
|---|---|---|---|
| 1,510,402 | 9/1924 | Hopwood | 273/29 A |
| 2,005,241 | 6/1935 | Robinson | 273/29 A |
| 2,280,376 | 4/1942 | Clark | 273/29 A |
| 3,180,643 | 4/1965 | Kallot | 273/29 A |
| 3,215,432 | 11/1965 | Lee et al. | 273/29 A |
| 3,563,544 | 2/1971 | Hedrick | 273/29 A |
| 3,966,205 | 6/1976 | Schain | 273/29 A |
| 3,993,306 | 11/1976 | Scott | 273/29 A |

*Primary Examiner*—Richard C. Pinkham
*Assistant Examiner*—T. Brown
*Attorney, Agent, or Firm*—Cullen, Sloman, Cantor, Grauer, Scott & Rutherford

[57] ABSTRACT

A tennis court has an upright net and a pair of laterally relative fair service areas. Upright posts are anchored adjacent and extend above the ends of the court net. An elongated rectangular practice serving net overlies, is coplanar with and engages the court net. The serving net inwardly of its ends and below its top is cut away defining an elongated rectantular opening above the court net adjacent the fair service areas. An upright divider post is arranged intermediately of the ends of the practice serving net extending the height thereof dividing the rectangular opening into a pair of rectangular openings. A pair of curtains of net material are coplanar with the serving net and at their top edges are connected thereto and depend into the pair of openings respectively. The lower edges of said curtains are adjustably spaced above said court net providing a pair of elongated adjustable height service apertures for receiving served tennis balls so as to fall within said fair service areas.

9 Claims, 6 Drawing Figures

TENNIS PRACTICE SERVING NET

BACKGROUND OF THE INVENTION

At the present time, there is no practical equipment to help the individual to improve his ability to stroke his serve consistently with accuracy because the player is most concerned in getting the ball over the net in the conventional tennis court configuration.

Teaching the individual to hit his serve to repeatedly land in the correct fair service areas does not tell the individual how well he is preparing himself for each time he hits the serve. The main disadvantage is that he does not develope a rhythm because he does not have a target to serve at other than the net itself.

Efforts have been made to provide aids for tennis players such as shown for illustration in the following U.S. Pat. Nos. 3,993,306, 3,180,643, 3,215,432, 3,966,205, 3,563,544.

SUMMARY OF THE INVENTION

It is an object of the present invention to help the interested tennis player improve his ability to hit his serves with more accuracy by the use of a target net opening above the original net.

It is an object to provide a practice serving net which will help the tennis player develope rhythm as he prepares his toss for hitting his serve through the target opening. Missing the target will indicate his stance, timing, properly tossing the ball at the right angle and correctly hitting the ball at the right height.

It is a further object to provide a practice serving net which will provide tennis instructors with a device to help his students develope the fine points of serving because the target gives the individual an incentive to improve his ability.

It is a further object to provide a practice serving net which will provide advanced players with a practice net to help them retain their rhythm for hitting their serves with accuracy and speed to improve their game.

It is a further object to provide a practice serving net having an adjustable service opening to suit the caliber of the player and wherein the better the player, the smaller will be the opening which can be adjusted.

It is another object to provide as a part of the practice serving net a rectangular opening directly adjacent the upper edge of the court net and adjacent to the fair service areas and which includes one or a pair of vertically adjustable curtains for regulating the vertical height of the practice service opening.

It is a further object to provide an improved support platform for the respective ends of the practice serving net by which the net may be properly anchored when in use and can be conveniently dismantled from the tennis court when not in use.

These and other objects will be seen from the following Specification and Claims in conjunction with the apended drawing.

DRAWING

It will be understood that the above drawing illustrates merely a preferred embodiment of the invention, and that other embodiments are comtemplated within the scope of the Claims hereafter set forth.

DETAILED DESCRIPTION OF THE INVENTION

Figure 1:
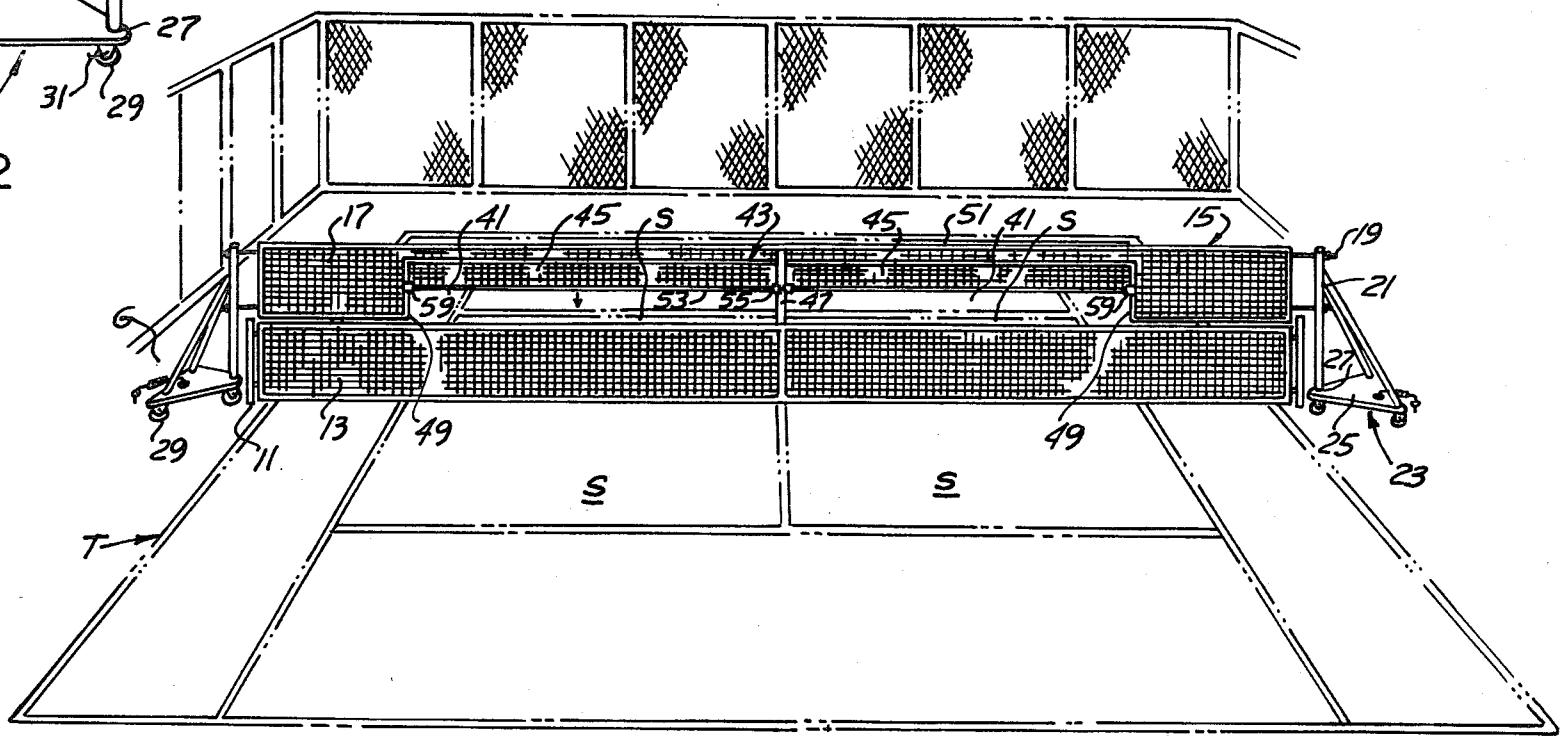
FIG. 1 is a front perspective view of a tennis court with a practice serving net applied thereto.

Referring to the drawing as shown in FIG. 1 upon a ground surface G there is provided a tennis court T having upon opposite sides of the conventional median net 13 opposed laterally related fair service areas S. Present practice serving net is generally indicated at 15 and includes a net body 17 of a material similar to the material of which the net 13 is contructed. A conventional net is shown anchored at its ends in a conventional manner by the upright posts 11 which extend into the ground surface.

Connected to ends of the practice serving net body are the vertically spaced pairs of tension member 19 which extend to and are ajustably secured to the upright posts 21.

These posts are arranged outwardly of posts 11 and are in some manner anchored to the ground surface in lateral alignment with posts 11. The posts 21 extend above the court net as shown in FIG. 1.

Figure 2:
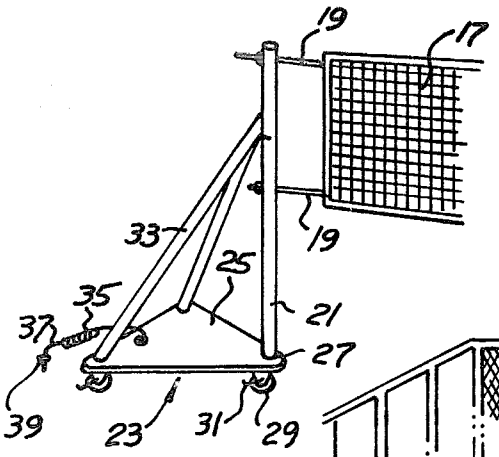
FIG. 2 is a fragmentary perspective view on an increased scale illustrating the anchoring of one end of the practice serving net.

In the illustrated embodiment, FIGS. 1 and 2 the respective posts 31 for the practice serving net are anchored at the lower end upon the base plate 25 of platform assembly 23 as at 27 such as by welding.

The base plate is triangular in form, and includes the three rubber wheels 29 connected thereto in a conventional castor arrangement.

The wheels include a conventional lever-lock 31 by which once locate as in FIG. 1, the wheels can be locked against rotation.

Posts 21 are reinforced by the converging additional reinforcements posts 33 which at their lower ends are secured at spaced points to platform 25. The upper ends of the posts converge together and are secured to an upper portion of post 21 as by welding.

Tie down 35 at one end secured to platform plate 25 and through a suitable hook 37 is secured to I bolt 39 which projects down into the ground surface.

The present practice serving net 15 overlies, is coplanar with and at its lower edge engages the court net 13.

Net 15 inwardly of its ends and below its top is cut away to define a rectangular opening 41 which is above the court net and is coextensive with and adjacent to the fair service areas S upon opposite sides of net 13.

Bounding the opening 41 in the practice serving net is a frame 43 supporting a pair of vertically adjustable curtains 45. The curtains are made of the same mesh material as the practice serving net body 17.

An upright divider post 47 is connected to and extends the height of the practice serving net intermediate its ends dividing the rectangular opening 41 into a pair of rectangular openings.

The practice serving net includes as bounding openings 41 the upright side members 49 which extend of right angles to the top 51 of the practice serving net.

The respective curtains 45 are secured at their upper ends to the respective frames 43 whereas their lower edges are anchored to the curtain rods 53.

The respective curtain rods at their ends adjustably interlock the post 47 and the end or side members 49.

Figure 3:
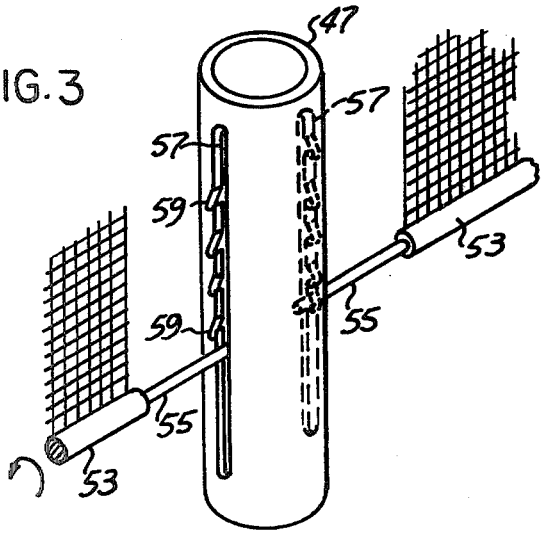
FIG. 3 is a fragmentary schematic view for adjustably supporting the ends of the curtain rods.

Various means may be imployed by which the curtain rod 53 anchored to the lower ends of the resective curtains may be vertically adjusted so as to vary the vertical height of the openings 41. FIG. 3 illustrates one means by which the end portions 55 of the rods 53 may be adjustably supported within the slot 57 shown within the center post 47, there being a similar slot within the side member 49. As shown in FIG. 3, along the slots 57 are a series of notches 59 adapted to adjustably receive end portions 55 of rods 53. These rods may be moved vertically with in the slot 57 or may be rotated therein winding up the curtain material 45 to variably adjust the vertical height of openings 41.

Figure 4:
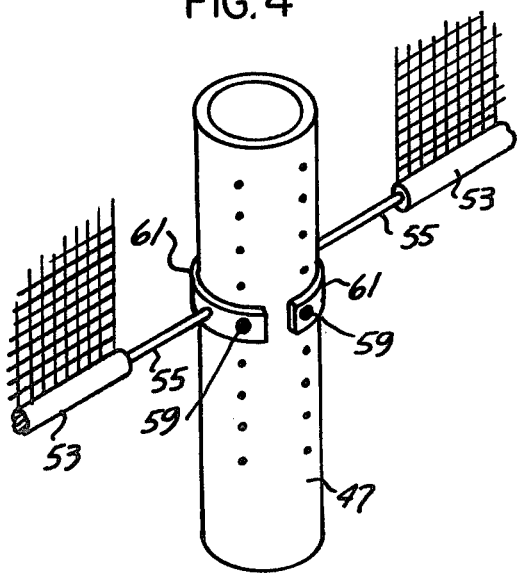
FIG. 4 shows a modified support mechanism therefore.

In FIG. 4, there is shown at the ends of the rods 53, semicircular clamps 61 which are anchored to the respective curtain rods 53 and adjustably secured to the corresponding post 47 and opposite posts or guides 49 as by fasteners 59.

Figure 5:
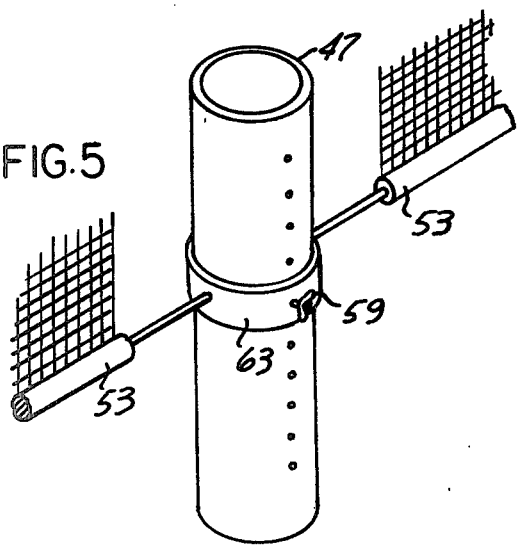
FIG. 5 shows another modification of the support for the curtain rods.

FIG. 5 fragmentarily shows a different type of clamp 63, of tubular form which extends around the post 47 and similarly connected to the guides 49 and anchored in position as by set screws or other fasteners 59.

Various clamp mechanisms may be employed which will adjustably anchor the respective ends of the curtain rods 53 with respect to posts 47 and the end guides 49.

Figure 6:
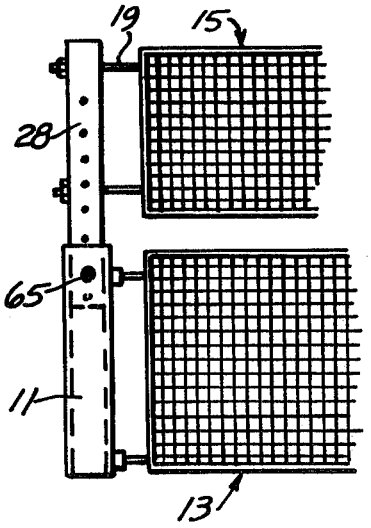
FIG. 6 is a schematic elevational view illustrating an alternative support for the practice serving net.

FIG. 6 schematically shows another means by which the practice serving net posts 28 may be anchored in an upright position. Here the posts 28 for the tension members 19 for the practice serving net 15 project down into the conventional net posts 11 and are secured thereto as by fasteners 65.

Various mechanical devices may be employed which will have the effect of adjustably anchoring and securing the respective opposite ends of the curtain rods 53 and by which as desired the vertical height of the practice target openings 41 may be regulated depending on the needs of the player.

Having described my invention, reference should now be had to the following Claims.

I claim:

1. In a tennis court apparatus upon a ground surface having an upright net spanning its median, there being a pair of laterally related fair service areas delineated in said court adjacent and upon opposite sides of said net;

a pair of spaced apart upright first posts, each post being anchored adjacent and extending above an end of the court net;

an elongated rectangular practice serving net overlying and coplanar with the court net and along its length, in registry therewith, along the length of said court net, and at its ends secured to said posts;

said net inwardly of its ends and below its top being cut away defining an elongated rectangular opening over said court net coextensive with said fair service areas;

an upright divider post upon and intermediate the ends of said practice serving net extending the height thereof, and dividing said rectangular opening into a pair of rectangular openings;

and a pair of curtains of net material coplanar with said serving net at their top edges connected thereto and depending into said pair of openings respectively, with their lower edges adjustably spaced above said court net providing a pair of elongated adjustable height service apertures of receiving a served tennis ball so as to fall within one of said fair service areas.

2. The tennis court apparatus of claim 1, including a pair of spaced upright tubular members anchored into the ground surface for supporting said court net;

each said upright first post at its lower end extending axially into one of said tubular member and secured thereto.

3. The tennis court apparatus of claim 1, wherein anchoring of said first posts includes a platform having wheels placed upon the ground surface outwardly of the ends of said court net, each of said post having its lower end secured to said platform;

means for releasably locking said wheels;

and a tie-down means for anchoring each platform to the ground surface.

4. The tennis court apparatus of claim 3, wherein each platform has a pair of converging reenforcement tubes secured at their lower ends to said platform at spaced locations thereon and spaced from said post;

said reenforcement tubes at their upper ends being secured to said post.

5. The tennis court apparatus of claim 1, wherein an upright guide post is secured to said practice serving net at the ends of said rectangular opening and spaced from said divider post;

a vertically adjustable horizontally disposed curtain rod positioned along and connected to the lower edge of each said curtain;

and a securing means at the ends of each said curtain rod adjustably interlocked with said divider post and guide posts respectively.

6. The tennis court apparatus of claim 5, wherein each said curtain rod being journalled at its ends upon said divider post and guide posts respectively and adapted on rotation to wind thereon portions of said curtains for modifying the height of said service openings.

7. The tennis court apparatus of claim 5, wherein a clamping means is provided at the end of each curtain rod adjustably interconnected with said divider post and guide posts for selectively raising and lowering the lower edge of each curtain.

8. The tennis court apparatus of claim 5, wherein said divider post and guide post having longitudinal slots therein;

end portions of each said curtain rod projecting into said slots and being guidably and adjustably retained upon said posts.

9. The tennis court apparatus of claim 5, wherein clamping means is connected to the end portions of said curtain rods and being adjustably secured to said divider post and said guide posts.

* * * * *